United States Patent [19]

Fink et al.

[11] 3,958,734

[45] May 25, 1976

[54] APPARATUS AND METHOD FOR CONTROLLING THE INVENTORY OF THE YARN MASS WITHIN A CONFINED SPACE

[75] Inventors: Roger H. Fink; William D. Porter, both of Asheville, N.C.

[73] Assignee: Akzona Incorporated, Asheville, N.C.

[22] Filed: Oct. 24, 1974

[21] Appl. No.: 517,786

[52] U.S. Cl. ..... 226/1; 226/119; 28/1.7

[51] Int. Cl.[2] ..... D02G 1/12

[58] Field of Search ..... 226/1, 118, 119; 28/1.7

[56] References Cited

UNITED STATES PATENTS

| | | | |
|---|---|---|---|
| 2,960,729 | 11/1960 | Russo et al. | 28/1.7 |
| 3,280,444 | 10/1966 | Stanley | 28/1.7 X |
| 3,798,719 | 3/1974 | Schrader | 28/1.7 |

FOREIGN PATENTS OR APPLICATIONS

| | | | |
|---|---|---|---|
| 108,712 | 5/1964 | Netherlands | 28/1.7 |

*Primary Examiner*—Allen N. Knowles
*Attorney, Agent, or Firm*—Craig & Antonelli

[57] ABSTRACT

An apparatus for controlling the inventory of a mass of compacted yarn within a confined space which comprises a yarn mass guide means including a cylindrical wall portion defining a yarn mass accumulation chamber, an inlet opening for delivery of the yarn mass into one end of the accumulation chamber, and an outlet opening for withdrawal of the yarn in the form of a yarn bundle from the accumulation chamber. The outlet opening is located in the cylindrical wall portion whereby the yarn bundle is withdrawn from an end of said yarn mass within said chamber towards a side thereof.

19 Claims, 4 Drawing Figures

APPARATUS AND METHOD FOR CONTROLLING THE INVENTORY OF THE YARN MASS WITHIN A CONFINED SPACE

This invention relates to an apparatus and method for controlling an inventory or accumulation of a yarn mass in a confined space and/or for withdrawing a yarn bundle from said yarn mass within said space and in particular, to an apparatus and method for sensing and controlling the position of a yarn plug within an accumulation chamber.

In the production of texturized yarns or like multifilament groups of synthetic polymeric materials, there are a number of pneumatic apparatus and processes for forming an elongated compacted yarn mass or plug. In these processes, a yarn made of thermoplastic polymeric material is conveyed to a confined space by a fluid jet or like pneumatic means. After accumulating within the space and after being heat-set, the yarn is then removed from the chamber and drawn into a yarn bundle.

In one known process (which is described in U.S. Pat. No. 3,373,470), the thermoplastic filaments are introduced into one end of an elongated confined space by a stream of fluid such as steam under pressure and at a temperature sufficient to set the filaments. The filaments are highly packed within the confined space by a controllably releasing part of the fluid from the confined space laterally of the space at a position spaced from the other end and the packed filaments are then forced through the space to the other end under pressure by the remaining portion of the fluid which exhausts with the yarn. The confined space required for this process is defined by metal springs having gaps between the convolutions thereof. In this apparatus, the yarn is propelled by the action of the fluid from a nozzle through a tubular passage and then into the interior of the spring. This spring is curved to a desired extent in order to provide optimum packing of the yarn in the form of a wad therein. The wad can be collected in this form or subjected to tension and the yarn then wound onto a bobbin.

A process and apparatus for continuously producing bulky yarns having a particularly high degree of random crimp is described in an application of Brewster B. Eskridge et al to be filed on even date herewith. In this process, a synthetic polymeric yarn is formed into a compacted plug within a bulking chamber. The plug of yarn formed in accordance with this process provides a firm peripheral surface that advantageously can be sensed by contacting, pneumatic, photoelectric or like sensor devices to signal high inventory or low inventory crimped yarn levels.

SUMMARY OF THE INVENTION

The present invention provides an apparatus and method for continuously sensing the position of a compacted yarn plug within a confined space and for providing signals which control the speed of withdrawing or taking-up a yarn bundle from the plug as well as signals for controlling the inventory of the yarn plug within the confined space.

More particularly, this invention contemplates an apparatus for controlling the inventory of a mass of compacted yarn which comprises a yarn guide means including a cylindrical wall portion defining a yarn accumulation chamber, an inlet opening for delivery of the yarn mass into one end of the accumulation chamber, and an outlet opening for withdrawal of the yarn in the form of a yarn bundle from the accumulation chamber; first yarn sensing means for establishing a high yarn level and a low yarn level within said chamber; and second yarn sensing means for monitoring withdrawal of the yarn bundle from the accumulation chamber.

The cylindrical wall portion of the yarn guide means is provided by a tubular member that has two open ends and that defines the accumulation chamber therebetween. Slots or openings are provided along the cylindrical wall of the tubular member for providing access to the yarn accumulation chamber. A yarn guide slot, which extends along a substantial portion of the length of the chamber, provides an elongated outlet opening for withdrawal of the initially formed yarn bundle. Since the yarn bundle is pulled from the plug at an angle to the longitudinal axis of the accumulation chamber, this slot also serves to retain the remaining portion of the yarn lug in its compacted condition.

In one embodiment of the invention, the first yarn sensing means includes two yarn sensing fingers which extend through respective slots in the tubular member defining the yarn accumulation chamber. One yarn sensing finger is positioned at a forward or entrance portion of the accumulation chamber corresponding to a low yarn level or inventory and the other yarn sensing finger is positioned at a rearward or exit portion corresponding to a high yarn level or inventory. The one yarn finger is in a depressed state during normal operation of the apparatus since the yarn plug is in a position so that the end being reformed into a yarn bundle is between the high and low yarn levels. The other yarn sensing finger extends upwardly through its associated slot in the tubular member and is normally in an extended position within the accumulation chamber.

The two yarn sensing fingers are operatively associated respectively with first and second microswitches. The first microswitch is maintained in a closed position when the one yarn sensing finger is depressed by the yarn plug; whereas, the second microswitch is kept in a closed position when the other sensing finger is extended. In this manner, there is no actuation of the circuitry which controls operation of the device for producing the yarn plug. If, however, the yarn plug moves out of its predetermined position and in front of the low yarn level, then the one yarn-sensing finger extends upwardly into the accumulation chamber causing the microswitch to open and thereby effect deactuation of the yarn plug-producing device.

On the other hand, if the yarn plug should extend past the other yarn sensing finger and cause it to become depressed, its operatively associated microswitch will become open and will thereby cause deactuation of the yarn plug-producing device. It will be recognized that other yarning sensors may be used in place of the yarn contacting fingers to determine the presence of the yarn plug at predetermined locations within the yarn accumulation chamber. For example, a light beam and an associated photoconductive device could be employed to generate an electric signal when the yarn plug either interrupts or fails to interrupt the light beam. This signal in turn could deactuate the yarn plug-producing device.

The second yarn sensing means includes another slot that is spaced from the other slots or opening provided in the tubular member. This slot extends longitudinally over that zone of the accumulation chamber where the yarn plug is preferably maintained during operation. An elongated blade-like sensing element is pivotally connected at one end to the tubular member and the other end extends through this slot. One edge of this element is biased against the surface of the periphery of the yarn plug. As the forward end of the yarn plug moves axially within the accumulation chamber, the one end of the blade-like sensing element is caused to move inwardly or outwardly of the accumulation chamber. A linkage means is placed in contact with another edge of one end of the blade-like sensing finger and causes actuation of a potentiometer which in turn produces signal that via a speed control unit regulates the rate of take-up or withdrawal of the yarn bundle from the accumulation chamber by a take-up device.

Operation of the apparatus of this invention is as follows. A firm, round - shaped plug or compacted yarn mass is formed by a yarn plug-producing device and is pushed by a pneumatic fluid through a conduit into the apparatus of the present invention. The yarn plug is introduced or delivered into the accumulation chamber defined by the tubular member. At this time, the yarn plug is moving at a speed of about 1/200th of the yarn speed into the yarn plug-producing device, that is, at a speed of about 2.5 to 10 meters per minute. The yarn plug enters an open end of the tubular member and initially passes over the yarn sensing finger which determines the low yarn level and which initially extends into the accumulation chamber. During start-up, this sensing finger and its associated microswitch are deactuated so that they will have no effect on the operation of the yarn plug-producing device. The yarn plug then proceeds to a point in the accumulation chamber where the yarn, in the form of a yarn bundle, is withdrawn at an angle to the longitudinal axis of the accumulation chamber, by a conventional take-up means such as, for example, a yarn package-forming spindle or like windup device. Near the other end of the accumulation chamber is provided the yarn sensing finger which is biased to extend into the chamber. If the yarn plug should contact this yarn sensing finger, it causes actuation of the control circuit which shuts down the plugproducing device and thereby provides a high yarn level protection. In the zone between the low and high level yarn sensing fingers, the blade-shaped sensing element which contacts the firm plug and, depending upon its position within the accumulation chamber, actuates a speed control means which may be electrical or pneumatic to regulate the speed of the withdrawal of the yarn bundle from the accumulation chamber so that the inventory of the yarn within the chamber can be maintained substantially constant.

The apparatus and method of this invention will be further understood from the following detailed description and with reference to the accompanying drawings wherein.

Figure 1:
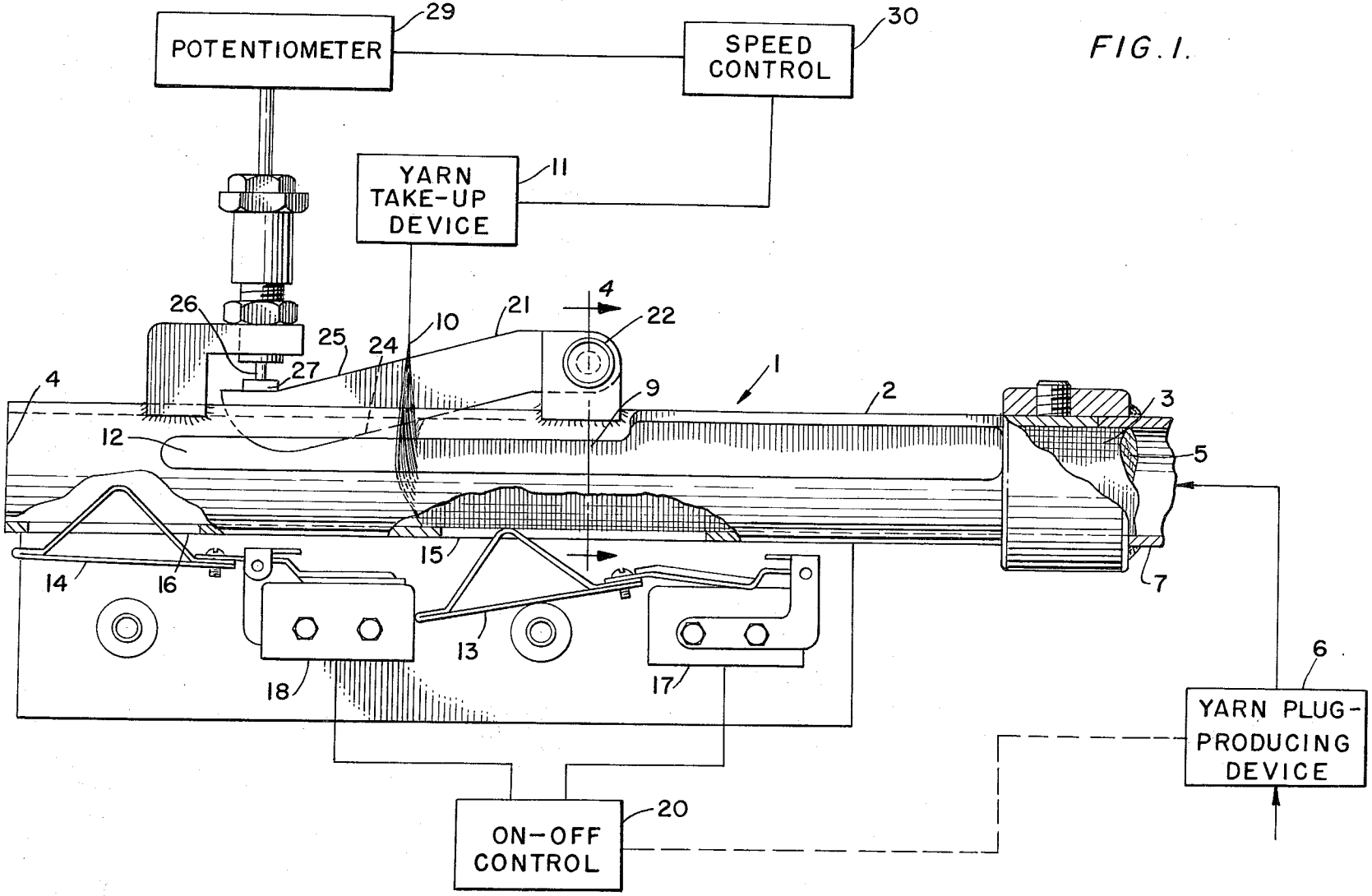
FIG. 1 is a perspective side view showing the apparatus for sensing and controlling the inventory of a yarn plug in a confined space in accordance with this invention used in connection with a yarn take-up device and a yarn plug-producing device.

In FIG. 1, reference numeral 1 generally designates the apparatus for sensing and controlling the inventory of a mass of compacted yarn, e.g. a yarn plug, within a confined space. This apparatus includes a yarn guide means comprising a tubular member 2 having two open ends 3 and 4 respectively. End 3 defines an inlet opening for delivery of a compacted yarn mass in the form of a plug 5. This mass of yarn is produced by a yarn plug-producing device schematically shown in the drawing and designated by reference numeral 6. The yarn plug is introduced into the opening at 3 via a conduit 7 which is secured to the end of the tubular member.

A slot 9 which extends along a substantial length of the tubular member defines an outlet opening for withdrawal of the yarn bundle 10 by a yarn take-up device 11. This device includes a spindle or the like for winding the yarn into a yarn package. The yarn bundle is pulled through slot 9 from the yarn plug at an angle of from about 30° to 90° with respect to the longitudinal axis of the tubular member. In this manner, the slot maintains the portion of the plug downstream of the yarn withdrawal in a compact condition. Also, it enables the take-up device to apply sufficient tension to the yarn bundle to pull the filaments together and to straighten out the filaments. Tubular member 2 defines a yarn accumulation chamber 12 wherein an inventory of the yarn mass in the form of a plug is maintained.

Figure 2:
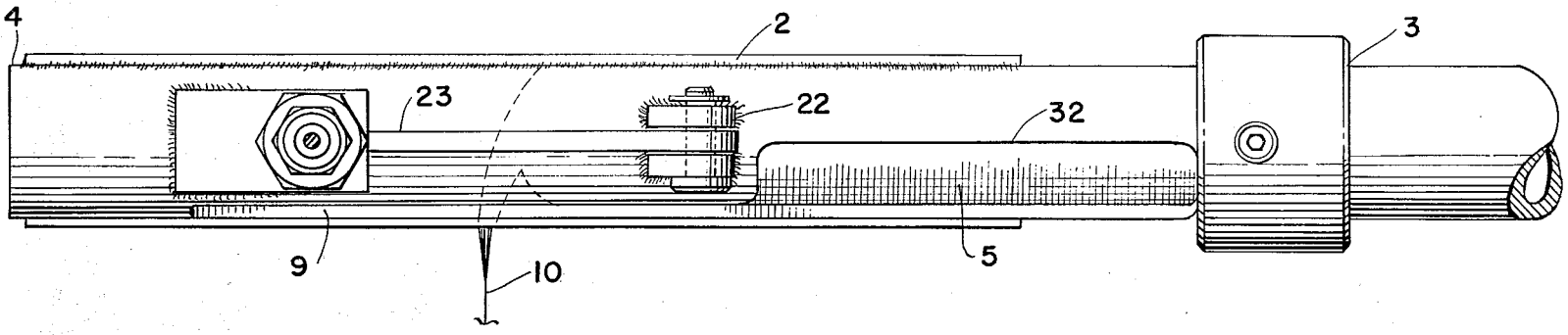
FIG. 2 is a top plan view of the yarn sensing and control apparatus shown in FIG. 1.

A first sensing means for determining the low and high levels of yarn inventory within said accumulation chamber includes yarn sensing fingers 13 and 14 which are biased towards the interior of the yarn accumulation chamber. These fingers as shown in FIGS. 1 and 2 enter into the accumulation chamber via slots 15 and 16. Each of these sensing fingers are resilient reed-like elements which are bent in the shape of a triangle so that they can be readily depressed by the presence of the firm yarn plug within the accumulation chamber.

Fingers 13 and 14 are, respectively, connected to microswitches 17 and 18 of conventional construction. When sensing finger 13 located at the forward end of the tubular member is in the depressed position shown in FIG. 1, microswitch 17 is maintained in a closed position; whereas, when sensing finger 14 at the rearward end is biased in its raised position within the accumulation chamber, microswitch 18 is also in a closed position. If the microswitches are in their closed positions, the circuitry of on-off control 20 to which they are connected allows the yarn plug-producing device to continue to operate. If however, either of the switches should be placed in its open position, then the on-off control 20 is actuated thereby shutting down the yarn plug-producing device. In this manner, the first yarn sensing means provides a protective control that prevents undue yarn waste if the yarn bundle should break and no longer be withdrawn by the take-up device 11.

Figure 4:
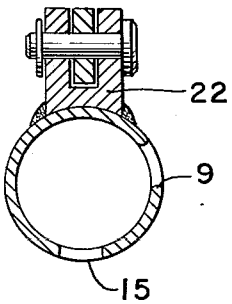
FIG. 4 is a cross-sectional view of the apparatus taken along line 4—4 in FIG. 1.
Figure 3:
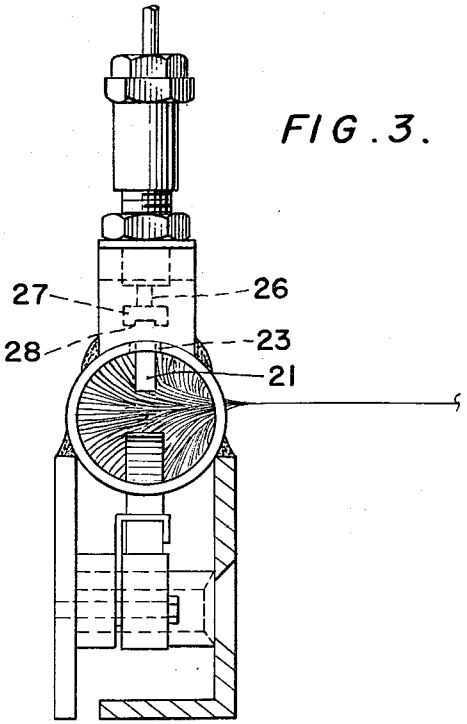
FIG. 3 is an end elevational view of the apparatus shown in FIG. 2.

The second yarn sensing means for controlling the speed of the yarn take-up device 11 comprises a blade-shaped sensing element 21 which is in the form of a lever pivotally mounted at one end in a support bracket 22 (as shown in FIG. 4). This bracket is welded or otherwise secured to the upper exterior surface of tubular member 2.

The other end of the sensing element 21 extends through a longitudinal slot 23 provided in the upper wall portion of the tubular member. The lower edge 24 of this sensing element rests on the yarn plug maintained within the zone of the accumulation chamber between the high and low yarn levels. The upper edge 25 of element 21 is in contact with a spring biased linkage 26. The end of linkage 26 is provided with a guide element 27. This guide element has a groove or channel 28 in which the upper edge 25 fits in sliding contact.

As the yarn plug moves forward in the yarn accumulation chamber, sensing element 21 is caused to pivot upwardly in a clockwise manner out of the accumulation chamber. During this movement, linkage 26 is actuated to cause the potentiometer 29 to vary its resistance. This change in resistance effects the speed control unit 30 which may be a D.C. motor or other conventional speed control device. Control unit 30 in turn increases the speed of the yarn take-up device 11. When the yarn plug releases the sensing element 21, i.e. allows the sensing element to pivot downwardly, the actions are reversed causing the yarn take-up device to slow down.

The tubular element 2 is also provided with an inspection and access opening 32 which is contiguous with the front portion of slot 9. This opening enables an operator of the apparatus to visually determine the condition of the yarn plug.

It will be appreciated that the foregoing embodiments of the first and the second yarn sensing means are merely exemplary of various sensing systems which may be used in the practice of the present invention. For example, if the take-up device is a yarnwinding head, the spring-biased linkage 26 may be replaced by a bicycle air-type valve which supplies air to a bellofram attached to a linkage carrying variable pitched pulleys. Whenever the yarn plug actuates sensing element 21, it would trigger the bicycle air value causing the bellofram pressure to change which in turn causes movement of the linkage carrying the variable pitch pulleys. This shift or movement causes the drive pulley pitch diameter to become slightly larger and the driven pulley pitch diameter to become slightly smaller thereby causing a yarn-winding head operatively associated with the variable pitch pulleys to speed up. Also, systems including photoconductive sensing elements or pneumatic sensing elements can in many cases be used for the first yarn sensing means described and illustrated in the drawings.

While the novel embodiments of the invention have been described, it will be understood that various omissions, modifications and changes in these elements may be made by one skilled in the art without departing from the spirit and scope of the invention.

What is claimed is:

1. An apparatus for controlling the inventory of a mass of compacted yarn within a confined space which comprises a yarn mass guide means including a cylindrical wall portion defining a yarn mass accumulation chamber for guiding and confining the yarn mass therein, an inlet opening means for permitting delivery of the yarn mass into one end of the accumulation chamber, and an outlet opening means for withdrawal of the yarn in the form of a yarn bundle from the accumulation chamber; first yarn sensing means for establishing a high yarn mass level and a low yarn mass level within said chamber for controlling the delivery of the yarn mass and second yarn sensing means responsive to the position of the yarn mass between said high and low yarn mass levels for monitoring withdrawal of the yarn bundle from the accumulation chamber.

2. The apparatus of claim 1, wherein said cylindrical wall portion is provided by a tubular member that has two open ends and that defines the accumulation chamber therebetween, one open end defining said inlet opening.

3. The apparatus of claim 2, wherein said outlet opening is in the form of a yarn guide slot which extends along a side portion of the length of the chamber between said high and low yarn mass levels.

4. The apparatus of claim 3, wherein said yarn guide slot extends parallel to a longitudinal axis of the tubular member.

5. The apparatus of claim 3, further comprising a yarn take-up device positioned to remove the yarn bundle through the yarn guide slot at an angle of from 30 to 90° to a longitudinal axis of said tubular member.

6. The apparatus of claim 5, wherein said yarn take-up device is operatively associated with said second yarn sensing means, said second yarn sensing means including another slot extending longitudinally along the tubular member and a sensing element extending through said another slot into said yarn accumulation chamber in contact with said yarn mass, and a linkage control means for varying the speed of the yarn take-up means to maintain the inventory of the yarn mass within said accumulation chamber substantially constant.

7. The apparatus of claim 2, wherein said first yarn sensing means includes two yarn sensing fingers which are arranged to contact the yarn mass within said yarn accumulation chamber, one yarn sensing finger being located at a forward position in the accumulation chamber corresponding to a low yarn level and the other yarn sensing finger being located at a rearward position corresponding to a high yarn level.

8. The apparatus of claim 7, further comprising a yarn plug-producing device for supplying the compacted mass of yarn in the form of a yarn plug to the inlet opening of said accumulation chamber.

9. The apparatus of claim 7, wherein a slot is provided to allow each of said yarn sensing fingers to enter into said yarn accumulation chamber, said one yarn sensing finger being depressed out of the accumulation chamber and said other yarn sensing finger being raised into said accumulation chamber when the inventory of yarn mass is at a level between the high yarn level and the low yarn level.

10. An apparatus for controlling the inventory of a mass of compacted yarn within a confined space which comprises a yarn mass guide means including a cylindrical wall portion defining a yarn mass accumulation chamber for guiding and confining the mass of compacted yarn, an inlet opening means for permitting delivery of the yarn mass into one end of the accumulation chamber, and an outlet opening for withdrawal of the yarn in the form of a yarn bundle from the accumulation chamber; said outlet opening being located in side portion of said cylindrical wall portion whereby said yarn bundle is withdrawn from an end of said yarn mass within said chamber towards a side thereof and the remaining portion of the yarn mass is said confined space is maintained in a compacted condition.

11. The apparatus of claim 10, wherein said cylindrical wall portion is provided by a tubular member that has two open ends and that defines the accumulation chamber therebetween, one open end defining said inlet opening.

12. The apparatus of claim 11, wherein said outlet opening is in the form of a yarn guide slot which extends along a portion of the length of the chamber and which is spaced from each of the two open ends.

13. The apparatus of claim 12 wherein said yarn guide slot extends parallel to a longitudinal axis of the tubular member.

14. The apparatus of claim 12, further comprising a yarn take-up device positioned to remove the yarn bundle through the yarn guide slot at an angle of from 30° to 90° to a longitudinal axis of said tubular member.

15. A method for sensing and controlling the inventory of a yarn plug within a confined space which comprises, continuously supplying a yarn plug to a confined space defined by a tubular member, withdrawing a yarn bundle from one end of the yarn plug and from said confined space at an angle to a longitudinal axis of said tubular member, sensing the position of the one end of said yarn plug in said confined space and controlling the rate of withdrawal of said yarn bundle to maintain the inventory of the yarn plug in said confined space substantially constant.

16. The method of claim 15, further comprising sensing when the one end of the yarn plug is at a high yarn level in said confined space and when the one end of the yarn plug is at a low yarn level within said space and stopping the supply of the yarn plug when the one end of the yarn plug is outside a zone between high and low yarn levels, said yarn being withdrawn through an opening extending along one side of said tubular member, between said high and low yarn levels.

17. A method for withdrawing a bundle of yarn from an elongated mass of compacted yarn without disrupting the integrity of the yarn mass which comprises introducing said yarn mass into a combined space defined by a cylindrical wall portion and withdrawing said yarn bundle from one end of the mass of yarn through a side opening in said wall portion at an angle to the direction of travel of said yarn mass into said confined space whereby the remaining portion of yarn mass adjacent to said one end is maintained in a compacted condition.

18. The method of claim 15, wherein said yarn bundle comprises a plurality of yarn filaments and said yarn bundle is withdrawn from said confined space under sufficient tension to pull said filaments together and to straighten out said filaments.

19. The method of claim 15, wherein said tubular member has an open end for entry of said yarn plug and further comprising supplying said yarn plug through said open end to said confined space.

* * * * *

UNITED STATES PATENT OFFICE
CERTIFICATE OF CORRECTION

Patent No. 3,958,734 Dated May 25, 1976

Inventor(s) Roger H. Fink and William D. Porter

It is certified that error appears in the above-identified patent and that said Letters Patent are hereby corrected as shown below:

Column 1, lines 27 and 28 should read "ments are highly packed within the confined space by controllably releasing a part of the fluid from the con-".

Column 2, line 56, "yarning" should read "yarn".

Column 3, line 44, "plugproducing" should read "plug-producing".

Column 5, line 35, "value" should read "valve".

Column 6, line 62, "mass is said" should read "mass in said".

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*